US006656030B2

(12) United States Patent
Xu et al.

(10) Patent No.: US 6,656,030 B2
(45) Date of Patent: Dec. 2, 2003

(54) UNSUPPORTED CHEMICAL MECHANICAL POLISHING BELT

(75) Inventors: Cangshan Xu, Fremont, CA (US); Brian S. Lombardo, Amherst, NH (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/036,624

(22) Filed: Nov. 9, 2001

(65) Prior Publication Data

US 2002/0068513 A1 Jun. 6, 2002

Related U.S. Application Data

(63) Continuation of application No. 09/386,741, filed on Aug. 31, 1999, now Pat. No. 6,406,363.

(51) Int. Cl.[7] ..... B24D 11/00

(52) U.S. Cl. ..... 451/526; 451/296

(58) Field of Search ..... 451/295, 296, 451/526, 527, 533, 534, 539, 41

(56) References Cited

U.S. PATENT DOCUMENTS 6,135,859 A * 10/2000 Tietz ..... 451/303
6,155,910 A * 12/2000 Lamphere et al. ..... 451/41
6,406,363 B1 * 6/2002 Xu et al. ..... 451/296

* cited by examiner

*Primary Examiner*—Joseph J. Hail, III
*Assistant Examiner*—David B. Thomas
(74) *Attorney, Agent, or Firm*—Brinks Hofer Gilson & Lione

(57) ABSTRACT

A belt for polishing a workpiece such as a semiconductor wafer in a chemical mechanical polishing system includes a polymeric layer forming an endless loop and having a polishing surface on one side of the endless loop. The belt is manufactured by molding a polymeric material such as urethane in a cylindrical mold. The belt is thus made from a single layer, reducing weight, size, cost and maintenance requirements.

11 Claims, 3 Drawing Sheets

100

UNSUPPORTED CHEMICAL MECHANICAL POLISHING BELT

This is a continuation of application Ser. No. 09/386,741, filed Aug. 31, 1999, now U.S. Pat. No. 6,406,363 B1, which application is incorporated herein in its entirety by this reference.

BACKGROUND OF THE INVENTION

The present invention relates generally to equipment for processing semiconductor wafers. More particularly, the present invention relates to a polishing belt and associated linear polisher for chemical mechanical polishing of semiconductor wafers.

Chemical mechanical polishing (CMP) is used for planarizing semiconductor wafers during processing of the wafers. Many steps in the manufacture of semiconductor devices produce a highly irregular surface of the front side of the wafer which contains the semiconductor devices. In order to improve the manufacturability of the devices on the wafer, many processing steps require planarizing the wafer surface. For example, to improve the uniformity of deposition of a metal interconnect layer, the wafer is planarized prior to deposition to reduce the peaks and valleys on the surface over which the metal is deposited.

In conventional planarization technology, a semiconductor wafer is supported face down against a moving polishing pad. Two types of polishing or planarizing apparatus are commonly used. In rotary planarizing technology, a wafer is secured on a chuck and is brought into contact with the polishing surface. A flat polishing pad mounted on a rotating table forms the polishing surface. In linear planarizing technology, an endless belt travels over two or more rollers. The wafer is placed against the moving polishing surface of the belt. An example of such a system is the Teres™ CMP System manufactured by Lam Research Corporation, Fremont, Calif.

A key component of a linear CMP system is the polishing belt. Conventionally, the belt includes a supporting band made of stiff material such as stainless steel. Polishing pads are attached to the stainless steel to form the polishing surface. For belts used on the Teres™ CMP System manufactured by Lam Research Corporation, Fremont, Calif., typically, four pads are used on a belt approximately 93.7 inches long. In some cases, the pads have two layers, for example, a soft cushion layer and a polishing layer. The stainless steel band forms a strong, reliable support for the polishing pads. The pads have a finite lifetime, for example, 500 wafers. When the pads become worn, the pads are removed, the stainless steel band is cleaned and new pads are installed.

While the conventional linear belt technology has been very successful, room for improvement remains. For example, the replacement of the pads is time consuming and the stainless steel band must be cleaned during each replacement of the pads. Because the stainless steel band is so large and relatively inflexible, it can be difficult to handle and to store. The stainless steel of the band may be a source of metal contamination of the semiconductor wafer. It has been suggested to use an integrated fabric reinforced polishing belt, which would combine the mechanical support and the polishing layer into a single, replaceable article. Also, it has been suggested that a high strength reinforcing component is necessary to allow proper tensioning and support of the polishing layer. However, such a belt has some practical limitations, including complexity of manufacturing and cost of materials.

Accordingly, there is a need in the art for an improved polishing belt for CMP systems.

SUMMARY OF THE INVENTION

By way of introduction only, an improved polishing belt for a chemical mechanical planarization (CMP) system is formed from a single endless layer of polymeric material and excludes any supporting layer such as stainless steel or reinforcing fibers. The single endless layer can be any suitable polishing material having sufficient strength, durability and flexibility. The belt is made, for example, by hot casting in a cylindrical mold. A grooved polishing surface can be added to the belt. Further, for certain applications, the polishing layer may be combined with additional layers to tailor the polishing performance of the belt.

The foregoing discussion of the preferred embodiments has been provided only by way of introduction. Nothing in this section should be taken as a limitation on the following claims, which define the scope of the invention.

DETAILED DESCRIPTION OF THE PRESENTLY PREFERRED EMBODIMENTS

Figure 1:
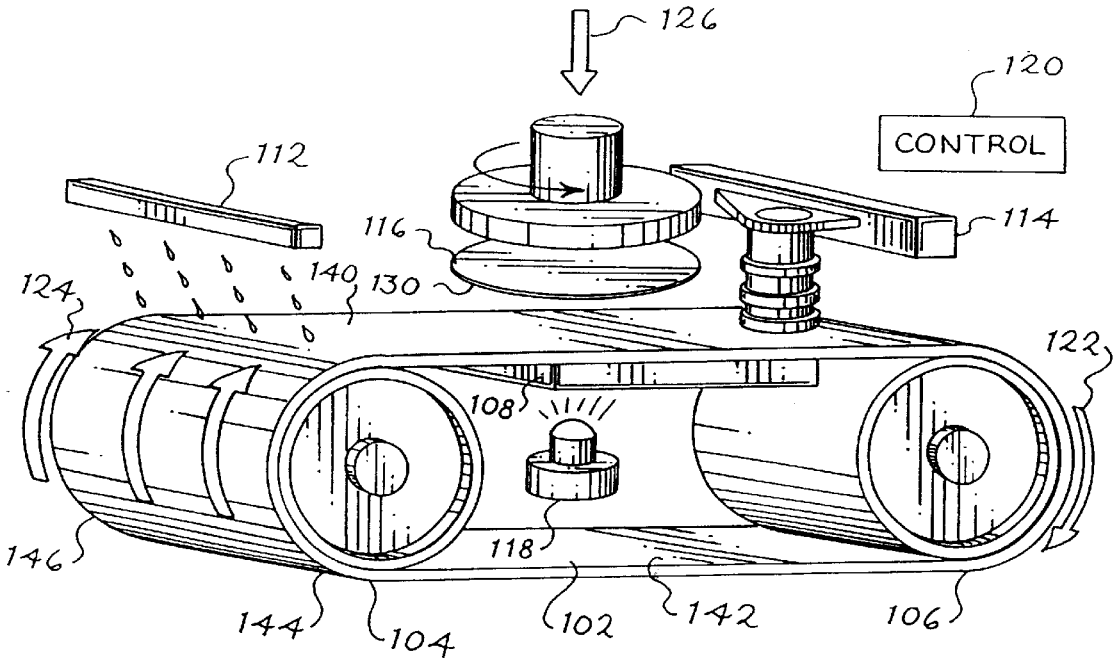
FIG. 1 is a perspective view of a linear chemical mechanical polishing system.

Referring now to the drawings, FIG. 1 is a perspective view of a linear chemical mechanical polishing or planarization (CMP) system 100 for polishing a workpiece. The system 100 includes a belt 102, a first roller 104, a second roller 106, a platen 108, a polishing head 110, a slurry dispenser 112, a conditioner 114, a monitoring system 118 and a controller 120. The system 100 in the illustrated embodiment is adapted for planarization of semiconductor wafers such as the semiconductor wafer 116. However, the operative principles embodied in the system 100 may be applied to chemical mechanical polishing of other workpieces as well.

The rollers 104, 106 are located a predetermined distance apart to retain the belt 102 and move the belt 102 to permit linear planarization of the wafer 116. The rollers 104, 106 are turned, for example, by an electric motor in the direction indicated by the arrows 122, 124 in FIG. 1. The rollers 104, 106 thus form a transport means for moving the belt in a continuous loop past the workpiece, wafer 116. Other transport means include combinations of wheels, pulleys and tensioning devices for which maintain proper tension on the belt 102, along with their associated drive elements such as electric motors and mechanical linkages. Operational parameters such as the speed and tension of the belt 102 are controlled through the rollers 104, 106 by a controller 120. The controller may include a processor or other computing device which operates in response to data and instructions stored in an associated memory.

The wafer 116 is mounted on the polishing head 110. The wafer 116 may be mounted and retained in place by vacuum force or by any other suitable mechanical technique. The polishing head 110 is mounted on an arm and is movable to an extent under control of the controller 120. The polishing head 110 applies a polishing pressure to the wafer 116 against the belt 102. The polishing pressure is indicated in FIG. 1 by the arrow 126.

To further control the polishing pressure, the platen 108 is located opposite the polishing head 110 below the wafer 116. The belt 102 passes between the front surface 130 of the wafer and the platen 108. The platen 108 applies pressure to the belt 102, for example by direct contact with the belt or by supplying pressurized air or water to the underside of the belt. In some applications, the platen 108 is arranged to apply pressure in controllable zones or areas of the platen 108 under control of the controller 120. For example, the zones may be arranged radially on the surface of the platen 108. This controlled application of pressure through the platen 108 allows the belt 102 to polish uniformly across the surface 130 of the wafer 116.

The slurry dispenser 112 dispenses a slurry onto the belt 102. The slurry is an important component of the chemical mechanical polishing process. Generally, the slurry includes two components. Different applications will have different components of the slurry, depending on the material to be removed or polished. In one example, abrasive particles such as silicon dioxide or alumina are combined with a chemical such as potassium hydroxide. The chemical operates to soften or hydrate the surface and the abrasive particles operate to remove the surface material. The exact components of the slurry are chosen based on the material to be polished or planarized. For example, the slurry components for planarizing a silicon dioxide layer on the surface 130 of the wafer 116 will differ from the slurry components for planarizing a metal layer on the surface 130. Similarly, the slurry components appropriate for a tungsten metal layer will be different from the components for a copper layer, which is softer than tungsten. For uniform planarization or polishing, it is important that the slurry be distributed evenly across the surface 130 of the wafer 116. In some cases chemical solutions without abrasive particles are used instead of slurry, and in those cases abrasive particles are often contained in the polishing pad itself.

The conditioner 114 treats the surface of the belt 102 to keep the belt's roughness or abrasiveness relatively constant. As the belt 102 planarizes or polishes the wafer 116, there is some deposit of the material removed from the wafer 116 on the surface of the belt 102. If too much material from the surface of wafer 116 is deposited on the belt 102, the removal rate of the belt 102 will drop quickly and the uniformity of abrasion across the wafer will be degraded. The conditioner 114 cleans and roughens the surface of the belt 102.

The belt 102 is preferably an endless loop polishing belt with no supplementary reinforcing or supporting components such as stainless steel, reinforcing fibers or fabric. In its simplest form, the belt 102 is made with a single endless layer which provides both the surface for polishing and the mechanical strength for mounting, tensioning and tracking the belt on the rollers 104, 106. The belt 102 for polishing a workpiece such as the wafer 116 in the chemical mechanical polishing system 100 includes a polymeric layer forming an endless loop having a predetermined width and a predetermined length to fit the chemical mechanical polishing system 100. The belt 102 has a top or polishing surface 140 on one side of the endless loop and a second or bottom surface 142 on the other side of the endless loop. In some cases, the belt may be reversible, where both the top surface 140 and the bottom surface 142 can be used for polishing. The belt has a first edge 144 and a second edge 146. The polymeric layer in one embodiment is manufactured exclusively of a single, substantially uniform layer of polymeric material, such as microcellular urethane, by a process such as hot cast molding. The polymeric material is of a substantially uniform thickness and structure. Thus, the belt 102 is manufactured without reinforcing or supporting layers or supporting components, such as aramid fibers, fabric or backing materials such as stainless steel.

The single endless layer forming the belt 102 can be any suitable polishing material with sufficient strength, flexibility, and durability. The polishing material can be made of any suitable polymeric material including rubbers or plastics. Examples of rubbers and plastics include but are not limited to, polyurethanes, polyureas, polyesters, polyethers, epoxies, polyamides, polycarbonates, polyetheylenes, polypropylenes, fluoropolymers, vinyl polymers, acrylic and methacrylic polymers, silicones, latexes, nitrile rubbers, isoprene rubbers, butadiene rubbers, and various copolymers of styrene, butadiene, and acrylonitrile. The polymeric material can be thermoset or thermoplastic. The polishing layer, which can be the single layer or another layer, can be solid or cellular. A solid layer is preferably uniformly solid throughout its length and cross section. Cellular polymer includes voids or porosity which helps the polishing process by carrying the slurry to the surface 130 of the wafer. The cells can be open or closed and can be formed by any suitable means, including but not limited to blowing, expansion, frothing, and inclusion of hollow microelements. In one application, the polymeric material is a microcellular polyurethane having cells or voids on the order of 0.1 to 1000 micrometers in size. The polishing layer can include various additives, including but not limited to lubricants and abrasive particles. The belt should be sufficiently elastic to maintain tension during use, i.e., not to relax and loosen during use. The belt may be expected to operate at temperatures ranging from −60 to +150° C.

As noted and described above, in its simplest embodiment, the belt 102 is formed of a single layer of polymeric material, such as polyurethane. In an alternative embodiment, the belt 102 in some applications can have multiple layers. For example, a second layer can be combined with the polymeric polishing layer. The additional layers can be made of any suitable polymeric material including rubbers or plastics. However in most cases the different layers will be made of different materials and have different properties, structures, dimensions, and functions. In one case a two-layer belt will have a top polishing layer as described above and a polymeric bottom layer that provides a desired effect. For example, putting a softer underlayer beneath the harder polishing layer increases the overall rigidity of the belt 102 but still allows enough softness so that the polishing layer can flex to conform to the surface of the wafer 116. Thus, by adding additional layers, the polishing performance of the belt 102 can be tailored to the workpiece or to the CMP system. Typically the outside or top surface of the belt will be the polishing surface, although the inside or bottom surface could be the polishing surface in some different configurations. In addition, the polishing belt may be reversible, and both surfaces of the belt may be used for polishing at the same or different times. The two surfaces may be used for different types of polishing operations, and multiple layer belts may comprise different materials tailored to different polishing applications.

Any suitable method can be used for attaching the second layer and any subsequent layers to the polishing layer. In one preferred example, the second layer may be cast directly onto the polishing layer. This is accomplished by first manufacturing the polishing layer (to be described below in conjunction with FIG. 6). This produces a rigid, solid ring having the shape of a cylinder. The ring is then placed in a mold. An insert is placed inside the ring and a liquid polymer layer is poured or inserted into the mold between the insert and the polishing layer. The polymer is allowed to cure and the completed belt is then removed from the mold. Another suitable method for adding a second layer to the polishing layer is to manufacture the second layer as a separate ring, either by molding, cutting from a sheet or by any other suitable method. The second layer can then be combined with the polishing layer with an adhesive.

The belt 102 can have any suitable dimensions necessary for effective operation. Different polishing tools such as the CMP system 100 may require different belt lengths. Different workpiece sizes may require different belt widths. Also, different types of polishing may require different overall thicknesses and different relative thicknesses of multiple layers. Either the top or bottom surfaces of the belt can be convex or concave or otherwise shaped to match the profile of the workpiece being polished or to match the rollers or supporting structures below the belt.

Figure 3:
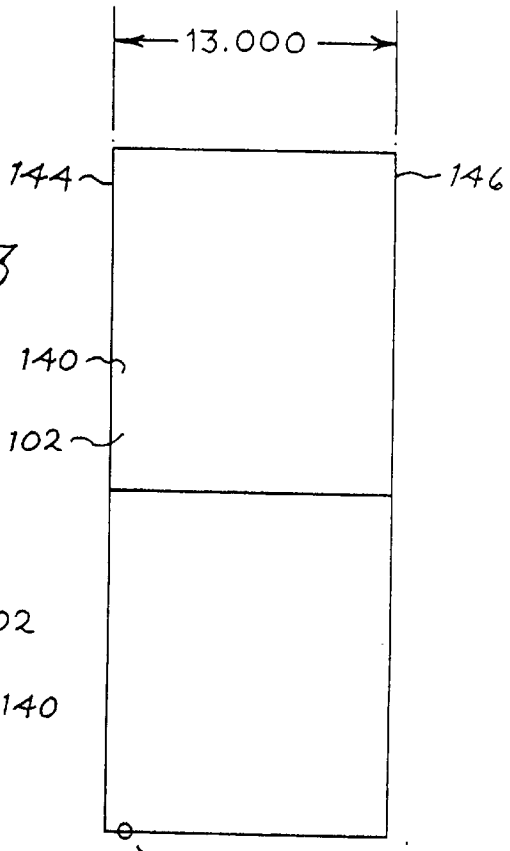
FIG. 3 is an end view of the belt of FIG. 1.
Figure 2:
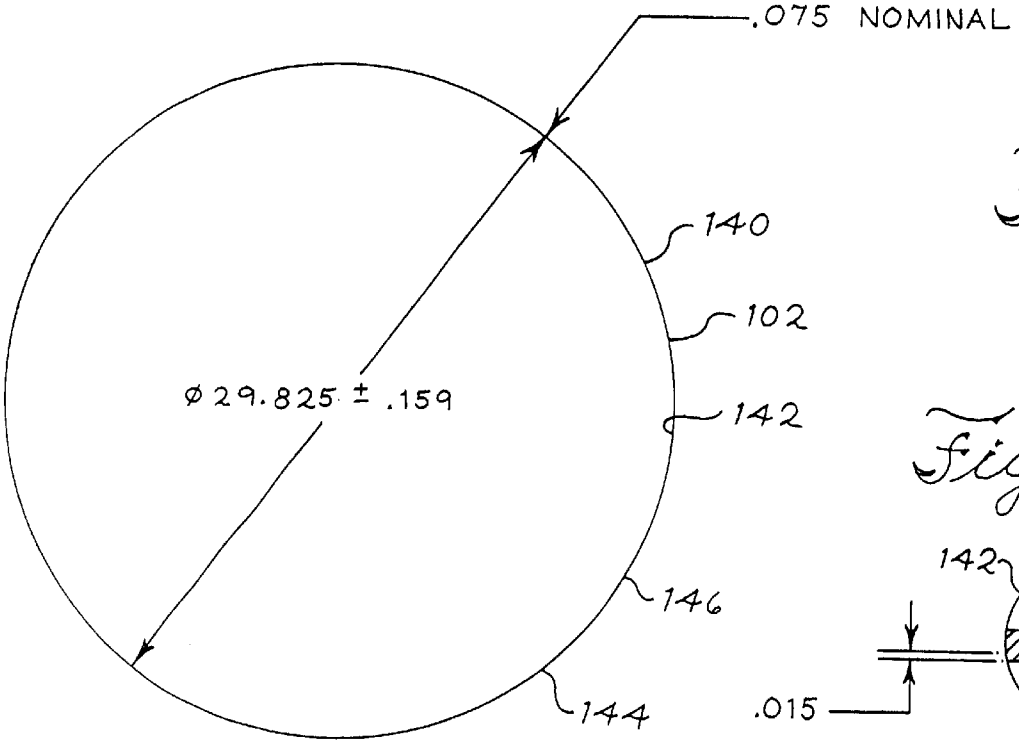
FIG. 2 is a side view of the belt of FIG. 1.

Referring to FIGS. 2 and 3, exemplary dimensions for the belt 102 are shown. FIG. 2 is a side view of the belt 102 and FIG. 3 is an end view of the belt 102. In FIG. 2, the belt 102 has a thickness of 0.020–0.200 inch and a nominal inner length of 90–110 inches. In FIG. 3, the width of the belt 102 is trimmed to 8–16 inches. In the illustrated embodiment, the belt 102 is sized for use with the Teres™ CMP system available from Lam Research Corporation, Fremont, Calif.

The polishing surface of the belt 102 can have any desirable texture or design necessary for effective polishing. The polishing surface can be smooth or textured. It can have grooves of any desired type, dimensions, pattern or design. The surface finish can be molded in or achieved by a machining or other secondary operation. Also, the grooves can be molded in or cut by a machining or other secondary operation. Examples of secondary operations useful for providing a surface finish and cutting grooves include but are not limited to sanding, cutting, milling, sawing, embossing, and laser ablating.

Figure 4:
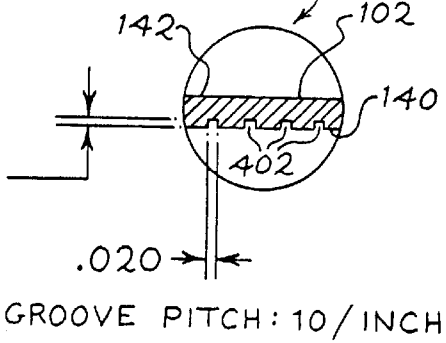
FIG. 4 is a cross-sectional detail view of the belt of FIG. 1.

FIG. 4 is a detail view of a portion of the belt 102. In FIG. 4, it can be seen that the polishing surface 140 of the belt 102 has a plurality of grooves 402 formed in the polishing surface 140. In the illustrated embodiment, the grooves 402 have a depth of 0.005–0.100 inch, a width of 0.005–0.100 inch and a pitch of 1–50 per inch. Other groove parameters may be substituted in different embodiments.

The bottom surface 142 of the belt 102 may be smooth or textured as desired. The bottom surface 142 may have grooves or ridges or other physical features that allow the belt to mate properly with rollers such as the rollers 104, 106 (FIG. 1) and pulleys. The texturing and physical features on the bottom surface 142 of the belt 102 may be molded in or may be achieved in secondary manufacturing operations.

The edges 144, 146 of the belt 102 may be smooth, textured, or patterned. The edges 144, 146 may contain holes or other physical features that serve a functional purpose, such as aiding in alignment and tracking of the belt in use or such as aiding in triggering or counting. Such holes will be described below in conjunction with FIG. 5. The edges of the belt 102 and any related features may be formed during molding or may be created in a secondary manufacturing operation such as cutting, drilling, lathing or punching.

Figure 5:
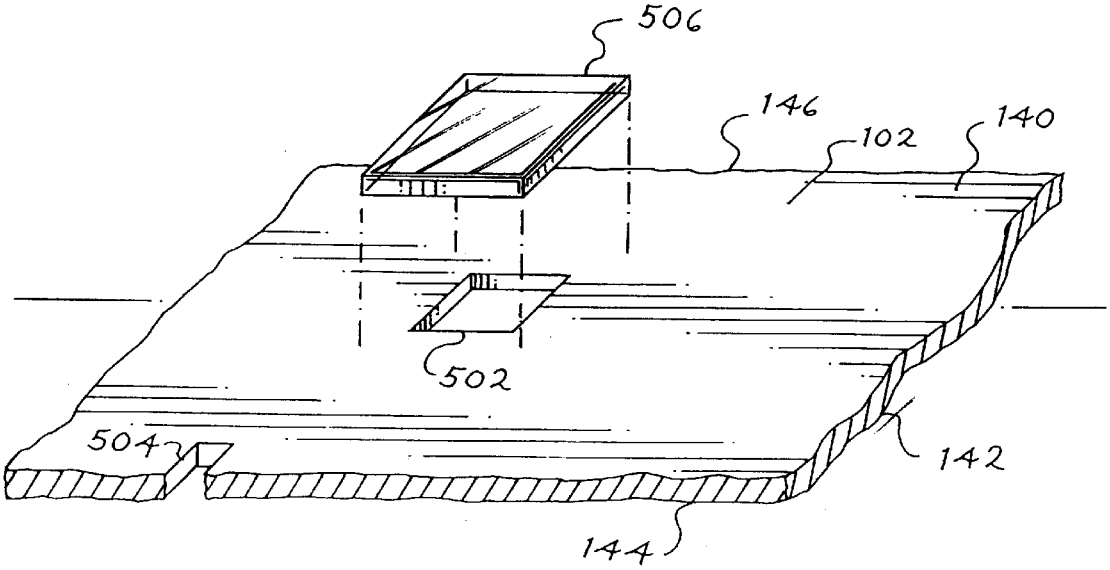
FIG. 5 is a perspective view of a portion of a belt for use in the system of FIG.1.

The belt 102 can have holes that penetrate all layers. FIG. 5 is a perspective view of a portion of the belt 102. In FIG. 5, a viewing hole 502 has been cut in the belt 102 to expose a portion of the workpiece, wafer 116 (FIG. 1) during polishing. Further, a trigger hole 504 has been formed in the belt 102 and is associated with the viewing hole 502. The holes are useful for allowing slurry transport or for optically monitoring the condition of the workpiece during polishing.

Thus, the chemical mechanical polishing system 100 of FIG. 1 includes the monitoring system 118. The monitoring system persistently or periodically shines light on the belt 102. As the viewing hole 502 passes the monitoring system 118, the trigger hole 504 engages a sensor to indicate to the monitoring system 118 that the viewing hole is present. In response the monitoring system 118 shines light or other energy on the belt 102 in the vicinity of the viewing hole 502 and also measures the light or other energy reflected back from the viewing hole. By measuring the energy and its variation, the measuring system can provide an indication of the polishing progress of the CMP system 100. The trigger hole 504 may be placed with any suitable relation to the viewing hole 502. Further, a plurality of viewing holes such as the viewing hole 502 may be formed in the belt. Provision of additional holes increases the acquisition frequency or number of data samples collected per revolution of the belt 102.

The belt 102 can have various depressions or protuberances. The belt 102 or certain areas of the belt 102 may be transparent to electromagnetic radiation or may be affixed with membranes or sheets or plugs that serve as transparent widows or optical pathways for use in monitoring the condition of the workpiece during polishing. Thus in an optional embodiment illustrated in FIG. 5, an optically clear panel 506 is positioned over the viewing hole 502. The belt may contain any of various types of sensors that may be used to monitor conditions of the belt, slurry, and workpiece during polishing.

Figure 6:
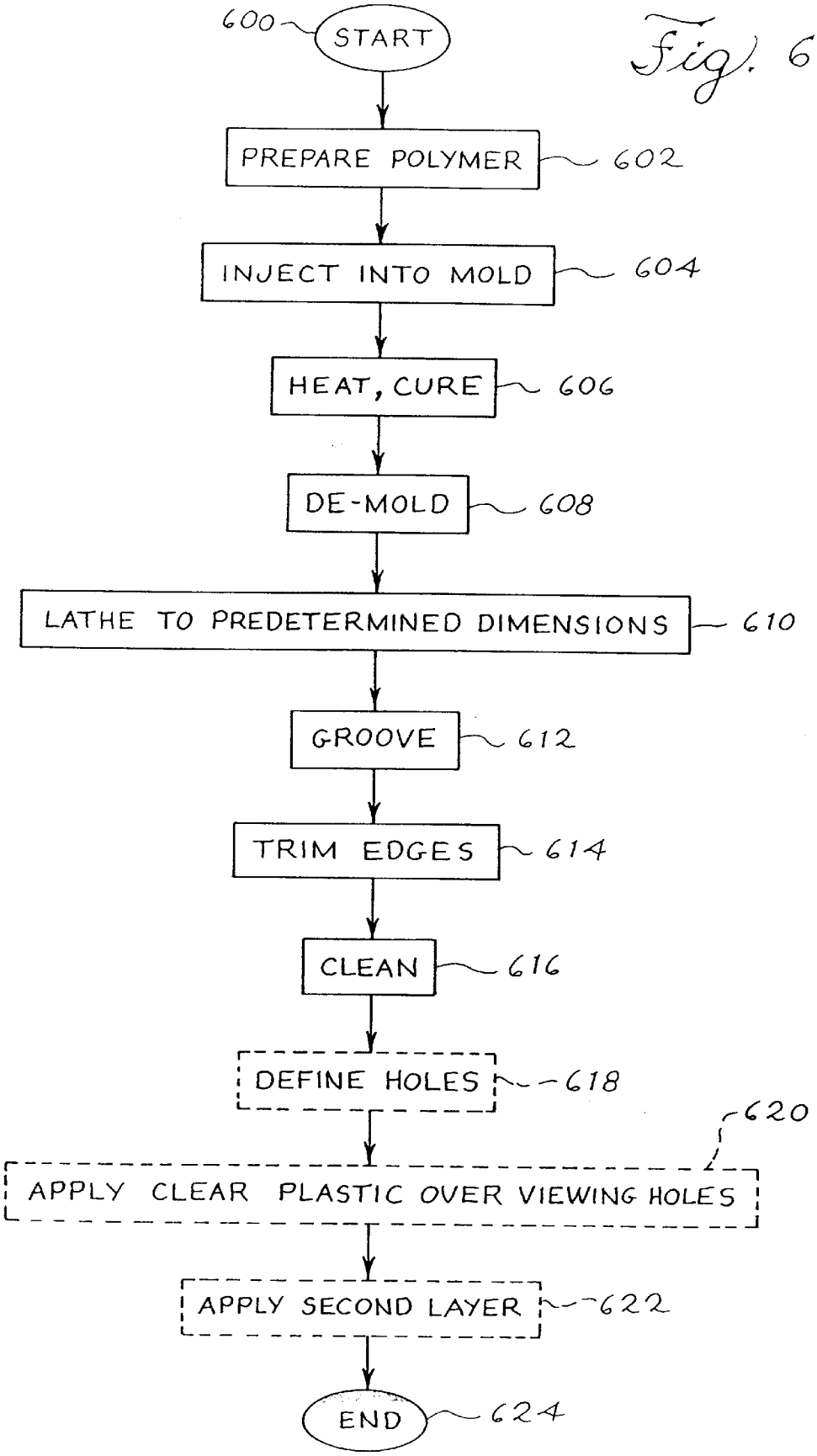
FIG. 6 is a flow diagram illustrating a method for manufacturing the belt of FIG. 1.

The belt 102 can be made by any suitable manufacturing method. Examples of methods include but are not limited to extrusion, injection molding, hot casting, pressing, rotational molding, and centrifugal molding. A belt with multiple layers can be made by directly forming one layer to the next, as noted above. FIG. 6 is a flow diagram illustrating a method for manufacturing a chemical mechanical polishing belt. The method begins at step 600.

At step 602, a polymer material is prepared for casting or injection molding. Other processes may be used as well. Preferably, a two-part polyurethane mixture is used, although any suitable polymer may be used. Generally, a flexible, durable, tough material is desired for the polishing layer of the finished belt. Further, the polishing layer should be soft enough to polish without scratching. The selected polymer need not be fully elastic, but should not slacken or loosen during use. Different polymers may be selected to enhance certain features of the polishing or planarizing process. In the illustrated embodiment, the polymer material is selected as a urethane mixture to produce a polishing material of the completed belt that is a microcellular polyurethane with a specific gravity of approximately 0.4–1.0 and a hardness of approximately 25–90 Shore D. A liquid resin and a liquid curative are combined to form the polyurethane mixture.

At step 604, the urethane mixture or other polymer material is dispensed into a hot cylindrical mold. Other types and shapes of molds may be suitably used. At step 606, the urethane mixture is heated and cured for a predetermined time at a predetermined temperature to form a urethane polishing layer. In the illustrated embodiment, the urethane mixture is cured for 12–48 hours at 150–300 degrees F (65–150 degrees C.). Other times and temperatures suitable to other polymer materials and other desired properties may be substituted. For example, thermoplastic materials are processed hot and set by cooling. At step 608, the belt is de-molded by removing the belt from the mold.

At step 610, grooves are formed on a polishing surface of the belt. The grooves may be formed during molding by providing a suitable pattern on the inside of the mold. However, in the illustrated embodiment, the raw casting is turned and grooved on a lathe to produce a smooth polishing surface with square shaped grooves such as the grooves illustrated in FIG. 5.

The polishing belt is then finished for use. At step 614, the edges of the belt are trimmed and at step 616 the belt is cleaned and prepared for use. In the illustrated embodiment, the completed belt is 90–110 inches in length, 8–16 inches wide and 0.020–0.200 inches thick. It is therefore suitable for use the Teres™ linear polishing tool manufactured by Lam Research Corporation.

Several additional optional steps are indicated by the dashed boxes in the flow diagram of FIG. 6. At step 618, if the belt is to be used with a monitoring system as illustrated in FIG. 1, one or more viewing holes are formed along a central region of the belt. The holes may be located along the centerline of the belt or any other suitable location. In the illustrated embodiment, the belt is 0.45 inches thick and has three holes along its centerline for monitoring the wafer during polishing. Further, a plurality of trigger holes is formed in predetermined locations related to the locations of the one or more viewing holes. The trigger holes tell the monitoring device below the belt when the centerline holes are in position to allow viewing of the wafer. In one embodiment, the trigger holes are located at the edge of the belt. At step 620, optically clear panels are positioned over the one or more viewing holes. In the illustrated embodiment, the thin sheets of optically clear material are adhered to the bottom side of the belt below the centerline viewing holes. The optically clear sheets function to allow viewing of the wafer or other workpiece while preventing slurry from falling through the viewing hole.

At optional step 622, a second layer is combined with the urethane polishing layer to form the belt. As described above, in one embodiment, the second layer may be directly cast onto the inside of the polishing layer. In an alternative embodiment, this is done to the raw casting before turning and grooving, step 612. The second layer is cast centrifugally, forming a uniform layer at the desired thickness with a smooth surface finish. In the illustrated embodiment, the second layer is a solid urethane elastomer with a thickness of approximately 0.020–0.200 inches and a hardness of approximately 10–99 Shore A. Other values and other parameters may be selected for the finished belt to tailor the belt's performance to a particular application. In a further alternative embodiment, the second layer is manufactured separately and then laminated to the polishing layer using a pressure sensitive adhesive after turning and grooving. The second layer is produced by centrifugally casting a thin endless belt. The thin endless belt may be cut open to form a long sheet of material before laminating to the endless polishing layer.

As can be seen from the foregoing, the present embodiments provide an improved, single layer, chemical mechanical polishing belt and method for manufacturing such a belt. The belt does not require a reinforcing component such as stainless steel or cloth or reinforcing fibers, as in the composite belts formerly used. The process for manufacturing the belt is simpler than previous composite belts. When the belt is worn, it is fully disposable. There is no need to remove and dispose of worn pads and clean the stainless steel layer. The belt may even be reversible to allow both surfaces of the belt to be used for polishing. The belt as described herein allows increased ability to optimize both local and global planarization of wafers without adding sublayers, by tailoring the cast construction of the belt. The belt has more uniform tension, reducing previous problems with uniform planarization. Further, the bulk and weight of the belt is reduced compared to the prior composite belts, since the new belt can be thinner and more flexible. This provides significant advantages in shipping, storing and handling of such belts.

While a particular embodiment of the present invention has been shown and described, modifications may be made. It is therefore intended in the appended claims to cover all such changes and modifications which follow in the true spirit and scope of the invention.

We claim:

1. A belt for polishing a workpiece in a chemical mechanical polishing system, the belt comprising:

a single polymeric layer with no supplementary reinforcing or supporting components, the single polymeric layer forming an endless loop sized to fit the chemical mechanical polishing system, the single polymeric layer having a polishing surface formed on a polishing side of the polymeric layer.

2. The belt of claim 1 wherein the single polymeric layer comprises polyurethane.

3. The belt of claim 1 wherein the polishing surface comprises groves formed in the polishing surface.

4. The belt of claim 1 wherein the belt comprises one or more viewing holes formed in the belt to expose a portion of the workpiece during polishing.

5. The belt of claim 1 wherein the belt further comprises a second layer which is directly cast onto an inside of the polymeric layer.

6. The belt of claim 1 wherein the belt is fabricated by hot cast molding of a single, substantially uniform layer of microcellular urethane.

7. A chemical mechanical polishing system for polishing a workpiece, the system comprising:

an endless loop polishing belt with no supplementary reinforcing or supporting components, formed of a single layer of polymeric material having a polishing surface on one side; and transport means for moving the continuous loop belt past the workpiece.

8. A belt for polishing a workpiece in a chemical mechanical polishing system, the belt comprising:

a single, polymeric layer hot-cast molded of a single, substantially uniform layer of polymeric material to form an endless loop sized to fit the chemical mechanical polishing system, the belt having no supplementary reinforcing or supporting components; and a polishing surface on a polishing side of the endless loop.

9. The belt of claim 8 further comprising:

one or more viewing holes formed in the belt to expose a portion of the workpiece during polishing.

10. The belt of claim 8 wherein the polishing surface comprises:

grooves formed in the polishing surface.

11. The belt of claim 8 wherein the polymeric material comprises microcellular urethane.

* * * * *

UNITED STATES PATENT AND TRADEMARK OFFICE

CERTIFICATE OF CORRECTION

PATENT NO. : 6,656,030 B2 
DATED : December 2, 2003
INVENTOR(S) : Cangshan Xu et al.

It is certified that error appears in the above-identified patent and that said Letters Patent is hereby corrected as shown below:

Column 3,
Line 2, after "comprises" delete "groves" and substitute -- grooves -- in its place.

Signed and Sealed this

Twenty-eighth Day of December, 2004

JON W. DUDAS
*Director of the United States Patent and Trademark Office*